US008141624B2

(12) United States Patent
Martin et al.

(10) Patent No.: US 8,141,624 B2
(45) Date of Patent: Mar. 27, 2012

(54) APPARATUS FOR HEATING A RESTAURANT KITCHEN, DINING ROOM, AND HOT WATER SUPPLY

(76) Inventors: Jeffrey R. Martin, Burlington (CA); Timothy J. Martin, Burlington (CA)

( * ) Notice: Subject to any disclaimer, the term of this patent is extended or adjusted under 35 U.S.C. 154(b) by 1330 days.

(21) Appl. No.: 11/427,085

(22) Filed: Jun. 28, 2006

(65) Prior Publication Data

US 2008/0035138 A1 Feb. 14, 2008

(51) Int. Cl.
*G05D 23/00* (2006.01)
*F24C 15/20* (2006.01)

(52) U.S. Cl. ..... 165/297; 165/909; 126/299 D; 126/300

(58) Field of Classification Search ..... 126/299 D, 126/300; 165/297, 909
See application file for complete search history.

(56) References Cited

U.S. PATENT DOCUMENTS 2,938,714 A * 5/1960 Gerrish ..... 165/297
3,762,394 A * 10/1973 Newcomer ..... 126/300
4,122,834 A * 10/1978 Jacobs ..... 126/299 D
4,129,179 A 12/1978 Molitor
4,171,722 A 10/1979 Huggins
4,216,903 A 8/1980 Giuffre
4,263,891 A * 4/1981 Mets ..... 126/299 D
4,274,845 A 6/1981 Howard
4,284,421 A 8/1981 Howard
4,367,787 A * 1/1983 Bradshaw ..... 165/297
4,382,807 A 5/1983 Diachuk
4,407,266 A * 10/1983 Molitor ..... 126/299 D
4,589,475 A * 5/1986 Jones ..... 165/297
5,558,080 A * 9/1996 Grohman et al. ..... 126/299 D
5,671,726 A * 9/1997 Hsu ..... 126/299 D
5,687,707 A 11/1997 Prasser
6,235,249 B1 5/2001 Fu et al.
6,543,526 B2 * 4/2003 Jacobs ..... 126/299 D
6,920,874 B1 7/2005 Siegel
7,588,025 B2 * 9/2009 Raus et al. ..... 126/299 D
7,866,312 B2 * 1/2011 Erdmann ..... 126/299 D
7,963,830 B2 * 6/2011 Luddy et al. ..... 126/299 D
8,033,322 B1 * 10/2011 Trent ..... 165/54
8,038,515 B2 * 10/2011 Livchak et al. ..... 126/299 D

* cited by examiner

*Primary Examiner* — Ljiljana Ciric
(74) *Attorney, Agent, or Firm* — Patrick J. Hofbauer

(57) ABSTRACT

An apparatus for recovering heat from exhaust air received from a restaurant kitchen. Rotating backwards inclined fan blades draw exhaust air from the kitchen along a flow path and impel it against walls of a housing, such that grease is removed from the exhaust air. A fan motor is positioned out of the flow path. The exhaust air is pushed out of the housing to a heat recovery coil directly downstream that is formed from a heat conductive material. The coil has an internal conduit through which a heat transfer fluid is supplied at a temperature below the exhaust air temperature, such that the fluid in the conduit is heated by exhaust air passing over the conductive material. After leaving the conduit, heat energy is transferred from the fluid to makeup air for return to, or to water for use in, the restaurant.

29 Claims, 7 Drawing Sheets

APPARATUS FOR HEATING A RESTAURANT KITCHEN, DINING ROOM, AND HOT WATER SUPPLY

FIELD OF THE INVENTION

The present invention relates to an apparatus for heating a restaurant, and more particularly, to an apparatus that recovers heat from grease-laden restaurant kitchen exhaust air to heat a restaurant, kitchen, dining room, and hot water supply.

BACKGROUND OF THE INVENTION

In restaurants, it may be advantageous to recover energy, using heat exchangers, from the hot air that may be ordinarily exhausted from the restaurant kitchen. It may also be advantageous for such a restaurant to extract grease from the hot kitchen exhaust air, preferably before attempting to recover heat energy from the exhaust air. As both processes may involve operations performed on the hot exhaust air, it may be particularly advantageous to generally combine both processes into one system.

In the prior art, the recovery of heat energy from kitchen exhaust air has been notoriously inefficient—at least in part because of the high grease content of the air which is exhausted from restaurant kitchens. It is, perhaps in large part because of these inefficiencies, that many have sought to improve the methods by which grease might be removed from the exhausted kitchen air before reaching a heat exchanger. Notably, however, the previous attempts to "degrease" kitchen exhaust air have given rise to significant problems of their own, in each of the varied, numerous and highly complex, ineffective, and/or hazardous devices which may have been previously employed for such purpose. Such prior art heat exchangers may have been generally classified into three different groups: (i) those employing chemical degreasing means, (ii) those attempting to degrease exhaust air using a complex system of filters and/or convoluted air flow conduits, and (iii) those which simply make use of an angled baffle together with an underlying grease trap.

Of course, it may be readily apparent that the use of chemicals to degrease exhaust air presents certain hazards to those who may be periodically charged with cleaning or otherwise servicing the heat exchangers. With reference to the use of filters and convoluted air flow conduits, on the other hand, it is generally believed, though not essential to the working or utility of the present invention, that such conduits and filters may significantly reduce the amount of energy remaining available for reclamation in any exhaust air which may, after passage through such structures, reach a heat exchanger. Accordingly, heat exchange devices in the second general grouping identified above may be substantially inefficient and/or may tend to result in a lower rate of energy transfer, such that restaurants employing same may not realize a significant savings in heat consumption. Additionally, it is generally believed, though not essential to the working or utility of the present invention, that restaurants using simple baffle and grease trap systems may typically have found such systems insufficient to remove any substantial amount of grease from the kitchen exhaust air.

It is noted that some previous heat exchanging devices may have included fans to draw grease-laden exhaust air from the restaurant kitchen. In the vast majority of these known heat exchange systems, however, the fans have even been positioned downstream of the heat exchanger, so as to draw the hot exhaust air therethrough. Such previous heat exchange systems have, notably, suffered from serious disadvantages, at least insofar as any kitchen exhaust air reaching the heat exchanger may have still been heavily laden with grease. As a result, grease in the exhaust air may have highly diminished the efficiency of the heat exchanger, and may heretofore have tended to accumulate as a coating over virtually all of the components, including the inner workings of the hear exchanger. Accordingly, such previous heat exchangers, grease "traps", and/or other grease removers may have previously required laborious cleaning on a regular basis. As may be appreciated from the foregoing, failure to clean these previous heat exchangers and their surrounding components may have typically resulted in a much lower efficiency in terms of energy transfer, with a correspondingly diminished savings in the restaurant's energy expenses.

While some previous heat exchange devices may have included heat exchange coils positioned downstream of the fans, such fans have not heretofore been used to remove grease from exhaust air. Moreover, fans previously disclosed for use in heat exchange systems would not have been effective to remove grease from exhaust air, due perhaps in part to the types of fans employed (e.g., axial flow fans) and/or to the slow fan rotation speeds. Accordingly, fans have not previously been used, in the field of restaurant heat exchangers, to degrease kitchen exhaust air. Rather, persons of ordinary skill in the art may heretofore have believed it necessary to utilize other de-greasing means which may be generally classified in one of the groups identified above.

It is, at this stage, perhaps worthwhile to also note that, there is another reason why many fans previously utilized in heat exchangers may not have been suitable for use in restaurant kitchen exhaust air heat exchangers, namely, because such use may give rise to significant safety concerns. That is, the fans in many previous heat exchangers have included fan motors which may heretofore have been disclosed as being positioned within the air flow path. It is generally thought, though not essential to the working or utility of the present invention, that the high heat and/or grease content that may typically be characteristic of restaurant kitchen exhaust air presents a certain fire hazard, which makes it unsafe to position an electric fan motor within the flow path of such exhaust. Accordingly, and despite any previous disregard for such concerns in the prior art, many previous heat exchangers that have included fans are neither safe nor suitable for use in association with restaurant kitchen exhaust air. In view of the foregoing, it should be appreciated that, quite apart from individuals concerned with other types of heat exchanging devices, persons having ordinary skill in the art have been required to specialize solely in the area restaurant heat exchangers as a unique field (with unique problems and concerns) unto its own.

Now, fans previously used in heat exchangers may have been adapted to spin at a user-selected speed, but any such ability to select a specific fan speed has heretofore been extremely limited—typically presenting only very limited options (e.g., two distinct and very specific speeds). While some previous fans may have been adapted to vary their speed in response to air temperature, such fans have not heretofore been used to remove the grease from kitchen exhaust air, nor would they have been effective for such use (due either to the types of fans being utilized and/or to the small range of slow speeds which may typically have been previously afforded by such fans). In order to particularly adapt a fan, in a restaurant heat exchanger, for use in removing grease from kitchen exhaust air, it would be advantageous to provide a fan that is capable of operating at high enough speeds to strip the grease from the exhaust air, whilst also being capable of varying its speed in direct response to the temperature of the kitchen exhaust air.

Apart from all of the above, it is important to recognize that prior art restaurant heat exchangers have only afforded users a minor degree of freedom in deciding how any heat recovered from kitchen exhaust air should be distributed. For example, after recovering heat energy from partially degreased kitchen exhaust air, some prior art heat exchangers may have provided for user-actuation of a three-way valve so as to enable selective distribution of the recovered heat energy between supply air and/or supply water to be returned to, or used within, the restaurant. Notably, the prior art does not disclose any means for efficiently and automatically activating and distributing the recovered heat energy in accordance with a restaurant owner's pre-selected priority schedule. In addition, the prior art has failed to address the need amongst restaurant owners for a greater degree of freedom and flexibility in deciding how any recovered heat energy should be distributed within the restaurant. Neither has the prior art offered an efficient and highly customizable method for prioritizing the delivery of recovered heat energy as between all of the following three (3) discrete systems which, according to the invention, are each recognized as being subject to their own unique heating demands in a restaurant: (a) supply air for delivery to the restaurant dining room, (b) hot water for use in the restaurant, and/or (c) makeup air for delivery back to the kitchen.

At this time, it is specifically noted that although attempts have been made, in the prior art, to develop efficient restaurant kitchen heat recovery systems, successful installations have not been documented.

Accordingly, there may be a need for an improved heat recovery system for use with restaurant kitchen exhaust air. Ideally, such a heat recovery system may be highly efficient at removing grease from restaurant's kitchen exhaust air, allowing recovered heat to be distributed as needed between the make-up kitchen air, the restaurant's hot water tank, and the restaurant's general eating area air supply.

In view of all of the foregoing, it may be particularly advantageous to provide a restaurant heat exchange system which includes a fan that is not only effective to substantially degrease the kitchen exhaust air, but also to push the largely degreased exhaust air downstream, substantially unimpeded, towards a heat exchanger that might then recover heat energy therefrom in a highly efficient manner. Such a system might most advantageously also enable greater flexibility and customization in determining how any recovered heat energy might be distributed within the restaurant. It is generally thought, though not essential to the working or utility of the present invention, that, such a system might result in a higher rate of energy transfer, in a higher overall efficiency, and/or in the ability to process of a high quantity of air. Additionally, the use of such a system might also afford a significant savings in terms of the restaurant's electricity and/or natural gas expenses.

It is an object of this invention to obviate or mitigate at least one of the above mentioned disadvantages of the prior art.

SUMMARY OF THE INVENTION

In accordance with the present invention there is disclosed a kitchen heat recovery apparatus for use with exhaust air received from a restaurant kitchen. The exhaust air is substantially laden with grease. The apparatus includes a fan, a heat recovery coil, a fluid delivery means, and a heat transfer means. The fan includes a fan motor, a fan housing, and fan blades. The fan housing has internal housing walls that at least partially surround the fan blades. The fan motor operatively rotates the fan blades to draw the exhaust air substantially laden with grease from the restaurant kitchen along an exhaust flow path. The rotation of the fan blades impels the exhaust air and grease against the internal housing walls, such that the grease substantially impinges and collects upon the internal housing walls, so as to remove substantially all of the grease from the exhaust air. The fan blades operatively rotate as aforesaid to push the exhaust air out of the fan housing in a downstream direction along the exhaust flow path. The fan motor is positioned out of the exhaust flow path. The heat recovery coil is formed from a material that is heat conductive and positioned in the exhaust flow path in substantially direct downstream relation from the fan housing. The heat recovery coil is shaped so as to define within itself a recovery conduit through which a heat transfer fluid is operatively supplied at an incoming fluid temperature that is below the temperature of the exhaust air. As such, the fluid in the internal recovery conduit is operatively heated by passage of the exhaust air along the exhaust flow path over the heat recovery coil. The fluid delivery means is in fluid communication with the recovery conduit, and is provided to operatively deliver the fluid therefrom. The heat transfer means operatively receives the fluid after being heated within the recovery conduit as aforesaid, and transfers heat energy from the fluid to at least one of makeup air for return to, and water for use in, the restaurant.

According to an aspect of one of the preferred embodiments of the invention, the fan may preferably, but need not necessarily, be a centrifugal type fan. The fan blades may preferably, but need not necessarily, be backwards-inclined fan blades.

According to an aspect of one of the preferred embodiments of the invention, the apparatus may preferably, but need not necessarily, include a first exhaust sensor, positioned in an upstream direction from the recovery coil, to measure the temperature of the exhaust air. Still further, the apparatus may preferably, but need not necessarily, include a fan motor controller, in electrical communication with the first exhaust sensor and with the fan motor, to electrically vary power supplied to the fan motor, and a rotation speed of the fan blades, preferably, but not necessarily, in directly dependent relation upon the temperature of the exhaust air.

According to a further aspect of one preferred embodiment of the invention, the power supplied to the fan motor may preferably, but need not necessarily, be varied on a substantially continuous basis, such that the rotation speed of the fan blades may preferably, but need not necessarily, be varied within a predetermined range of desired fan speeds.

According to a further aspect of one preferred embodiment of the invention, the predetermined range may preferably, but need not necessarily, be substantially within the range of between about 180 RPMs and about 2000 RPMs.

According to a further aspect of one preferred embodiment of the invention, the predetermined range may preferably, but need not necessarily, be substantially within the range of between about 800 RPMs and about 1700 RPMs.

According to a further aspect of one preferred embodiment of the invention, the predetermined range may preferably, but need not necessarily, be pre-selected by a user.

According to another aspect of one of the preferred embodiments of the invention, the apparatus may preferably, but need not necessarily, include a first duct means for operatively supplying a first current of makeup air along a first makeup flow path, preferably to at least a first one selected from the group consisting of the kitchen and a dining room of the restaurant. The heat transfer means may preferably, but need not necessarily, include a first heat transfer coil formed at least in part from a first material that is heat conductive and positioned in the first makeup flow path. The heat transfer coil is preferably, but need not necessarily, shaped so as to define within itself first transfer conduit through which the fluid is selectively supplied at a first heated fluid temperature that may preferably, but need not necessarily, be above the temperature of the first current of makeup air. As such, the first current of makeup air may preferably, but need not necessarily, be heated in passage along the first makeup flow path over the heat recovery coil.

According to a further aspect of one preferred embodiment of the invention, the first duct means may preferably, but need not necessarily, operatively supply the makeup air along the makeup flow path to the kitchen and the dining room of the restaurant. The makeup flow path defines a main flow path that may preferably, but need not necessarily, have the first material of the first heat transfer coil positioned therein. The makeup flow path may also preferably, but not necessarily, define at least two subsidiary flow paths that may preferably, but need not necessarily, diverge from the main flow path in a downstream direction from the first material. The subsidiary flow paths may preferably, but need not necessarily, include a kitchen flow path that selectively supplies the makeup air to the kitchen, and a dining room flow path that selectively supplies the makeup air to the dining room. The heat transfer means may preferably, but need not necessarily, also include a second heat transfer coil that is formed, at least in part, from a second material that is heat conductive, which second heat transfer coil is preferably, but not necessarily, positioned in the dining room flow path. The second heat transfer coil is preferably shaped so as to define within itself second transfer conduit through which the fluid is selectively supplied at a second heated fluid temperature that is may preferably, but not necessarily, above the temperature of the makeup air leaving the first heat transfer coil. As such, the makeup air may preferably, but need not necessarily, be heated in passage along the dining room flow path over the second heat transfer coil.

According to a further aspect of one preferred embodiment of the invention, the apparatus may preferably, but need not necessarily, also include a flow impeding means, positioned within the first duct means, for selectively impeding supply of the makeup air preferably, but not necessarily, along at least one of the kitchen flow path and the dining room flow path.

According to a further aspect of one preferred embodiment of the invention, the flow impeding means may preferably, but need not necessarily, include a louvered panel that is positioned in the kitchen flow path. The louvered panel may preferably, but need not necessarily, have louvers that may preferably, but need not necessarily, be selectively movable between an opened panel configuration and a closed panel configuration. In the opened panel configuration, the supply of makeup air to the kitchen may preferably, but need not necessarily, be substantially unobstructed by the louvers. In the closed panel configuration, the louvered panel may preferably, but need not necessarily, substantially obstruct the supply of makeup air to the kitchen.

According to a further aspect of one preferred embodiment of the invention, movement of the louvers between the opened panel configuration and the closed panel configuration may preferably, but need not necessarily, be mechanically actuated by a louver motor. The louver motor may preferably, but need not necessarily, be electrically actuated by a louver controller.

According to a further aspect of one preferred embodiment of the invention, the apparatus may preferably, but need not necessarily, also include a second heat transfer coil sensor that may preferably, but need not necessarily, be positioned in a downstream direction from the second heat transfer coil, to measure the temperature of the makeup air leaving the second heat transfer coil. The louver controller may preferably, but need not necessarily, be in electrical communication with the second heat transfer coil sensor and with the louver motor. The louver controller may preferably, but need not necessarily, control movement of the louvers between the opened panel configuration and the closed panel configuration, preferably, but not necessarily, in directly dependent relation upon the temperature of the makeup air leaving the second heat transfer coil.

According to another aspect of an alternate one of the preferred embodiments of the invention, the apparatus may preferably, but need not necessarily, also include a second duct means for supplying a second current of makeup air along a second makeup flow path preferably, but need not necessarily, to the respective other one selected from the group consisting of the kitchen and the dining room of the restaurant. According to this aspect of the invention, the heat transfer means may preferably, but need not necessarily, also include a second heat transfer coil that is formed at least in part from a second material that is heat conductive and is preferably, but not necessarily, positioned in the second makeup flow path. The second heat transfer coil is preferably, shaped so as to define within itself second transfer conduit through which the fluid may preferably, but need not necessarily, be selectively supplied at a second heated fluid temperature that may preferably, but need not necessarily, be above the temperature of the second current of makeup air. As such, the second current of makeup air may preferably, but need not necessarily, be heated in passage along the second makeup flow path over the second heat transfer coil.

According to an aspect of one of the preferred embodiments of the invention, each of the aforesaid heat transfer coils may preferably, but need not necessarily, be a finned heat transfer coil.

According to an aspect of one of the preferred embodiments of the invention, the fluid delivery means may preferably, but need not necessarily, include at least one three-way valve that is may preferably, but not necessarily, positioned in substantially juxtaposed fluid communication between the recovery conduit and each of the aforesaid transfer conduits. The three-way valve may preferably, but need not necessarily, receive fluid from the recovery conduit, and it may preferably, but not necessarily, selectively distribute the fluid between the first transfer conduit and the second transfer conduit. The three-way valve may preferably, but need not necessarily, be selectively movable between a first position and a second position. In the first position, the fluid operatively flows through the three-way valve preferably, but not necessarily, solely towards the first transfer conduit. In the second position, the fluid operatively flows through the three-way valve preferably, but not necessarily, solely towards the second transfer conduit.

According to an aspect of one of the preferred embodiments of the invention, the apparatus may preferably, but need not necessarily, also include a plumbing means for selectively supplying water along a water flow path to the restaurant. The heat transfer means may preferably, but need not necessarily, further include a water heat transfer unit that is formed at least in part from a third material that is heat conductive. The water heat transfer unit is preferably positioned in the water flow path. The water heat transfer unit preferably defines within itself third transfer conduit through which the fluid is selectively supplied at a third heated fluid temperature that may preferably, but need not necessarily, be above the temperature of the water. As such, the water may preferably, but need not necessarily, be heated in passage along the water flow path over the water heat transfer unit.

According to a further aspect of one preferred embodiment of the invention, the fluid delivery means may preferably, but need not necessarily, include first and second three-way valves. The first three-way valve may preferably, but need not necessarily, be positioned in substantially juxtaposed fluid communication between the recovery conduit, the first transfer conduit, and the third transfer conduit, preferably so as to receive fluid from the recovery conduit, and so as to preferably, but not necessarily, selectively distribute the fluid between the first transfer conduit and the third transfer conduit. The second three-way valve may preferably, but need not necessarily, be positioned in substantially juxtaposed fluid communication between the recovery conduit, the second transfer conduit, and the third transfer conduit, preferably so as to receive fluid from the recovery conduit, and so as to preferably, but not necessarily, selectively distribute the fluid between the second transfer conduit and the third transfer conduit. Each respective one of the three-way valves may preferably, but need not necessarily, be selectively movable between a first position and a second position. In each respective one of the first positions, the fluid operatively flows through the respective the three-way valve preferably, but not necessarily, solely towards the third transfer conduit. In each respective one of the second positions, the fluid operatively flows through the respective the three-way valve preferably, but not necessarily, solely towards a respective one of the first transfer conduit and the second transfer conduit.

According to another aspect of some of the preferred embodiments of the invention, the apparatus may preferably, but need not necessarily, also include a valve controller preferably for electrically actuating movement of each respective one of the three-way valves preferably, but not necessarily, between the first position and the second position.

According to a further aspect of one preferred embodiment of the invention, the apparatus may preferably, but need not necessarily, also include at least one temperature sensor to measure a current temperature preferably, but not necessarily, of a selected one of the exhaust air, the water for the restaurant, and the makeup air that is preferably, but not necessarily, supplied to one of the kitchen and the dining room. The valve controller may preferably, but need not necessarily, be in electrical communication with the temperature sensor and preferably, but not necessarily, with at least one of the three-way valves, preferably, but not necessarily, so as to control movement of the three-way valve between the first position and the second position, preferably, but not necessarily, in dependent relation upon the current temperature.

According to a further aspect of one of the preferred embodiments of the invention, the valve controller may preferably, but need not necessarily, electrically actuate movement of each respective one of the three-way valves between the first position and the second position in dependent relation upon a prioritisation of heat energy transfer that is preferably, but not necessarily, predetermined, preferably, but not necessarily, as between at least two of the dining room, the kitchen, and the water for use in the restaurant.

According to another aspect of one of the preferred embodiments of the invention, the fan housing may preferably, but need not necessarily, include a perforated housing wall that may preferably, but need not necessarily, be substantially juxtaposed between the fan blades and the recovery coil along the exhaust flow path. An inner face of the perforated housing wall may preferably, but need not necessarily, define one of the internal housing walls.

According to another aspect of one of the preferred embodiments of the invention, the apparatus may preferably, but need not necessarily, also include an exhaust duct that operatively conveys the exhaust air along the flow path in substantially unobstructed relation between the fan housing and the recovery coil.

According to a further aspect of one preferred embodiment of the invention, the exhaust duct may preferably, but need not necessarily, define a bend in the flow path between the fan housing and the recovery coil.

According to another aspect of one of the preferred embodiments of the invention, the fluid delivery apparatus may preferably, but need not necessarily, include an expansion tank having an internal diaphragm, a skimmer, and a fluid delivery pump. The expansion tank may preferably, but need not necessarily, be positioned in a substantially downstream fluid direction from the recovery coil. The skimmer may preferably, but need not necessarily, be positioned substantially downstream from the expansion tank, and the fluid delivery pump may preferably, but need not necessarily, be positioned substantially downstream from the skimmer. The heat transfer means may preferably, but need not necessarily, be positioned substantially downstream from the fluid delivery pump.

According to another aspect of one of the preferred embodiments of the invention, the apparatus may preferably also include fluid return means in fluid communication with the heat transfer means, preferably, but not necessarily, for operatively returning the fluid from the heat transfer means to the recovery coil.

According to another aspect of one of the preferred embodiments of the invention, the apparatus may preferably, but need not necessarily, be particularly adapted for use as a roof-mounted unit.

According to another aspect of one of the preferred embodiments of the invention, each one of the materials may preferably, but need not necessarily, be constructed at least in part from copper.

It is thus an object of this invention to obviate or mitigate at least one of the above mentioned disadvantages of the prior art.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the kitchen heat recovery apparatus according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
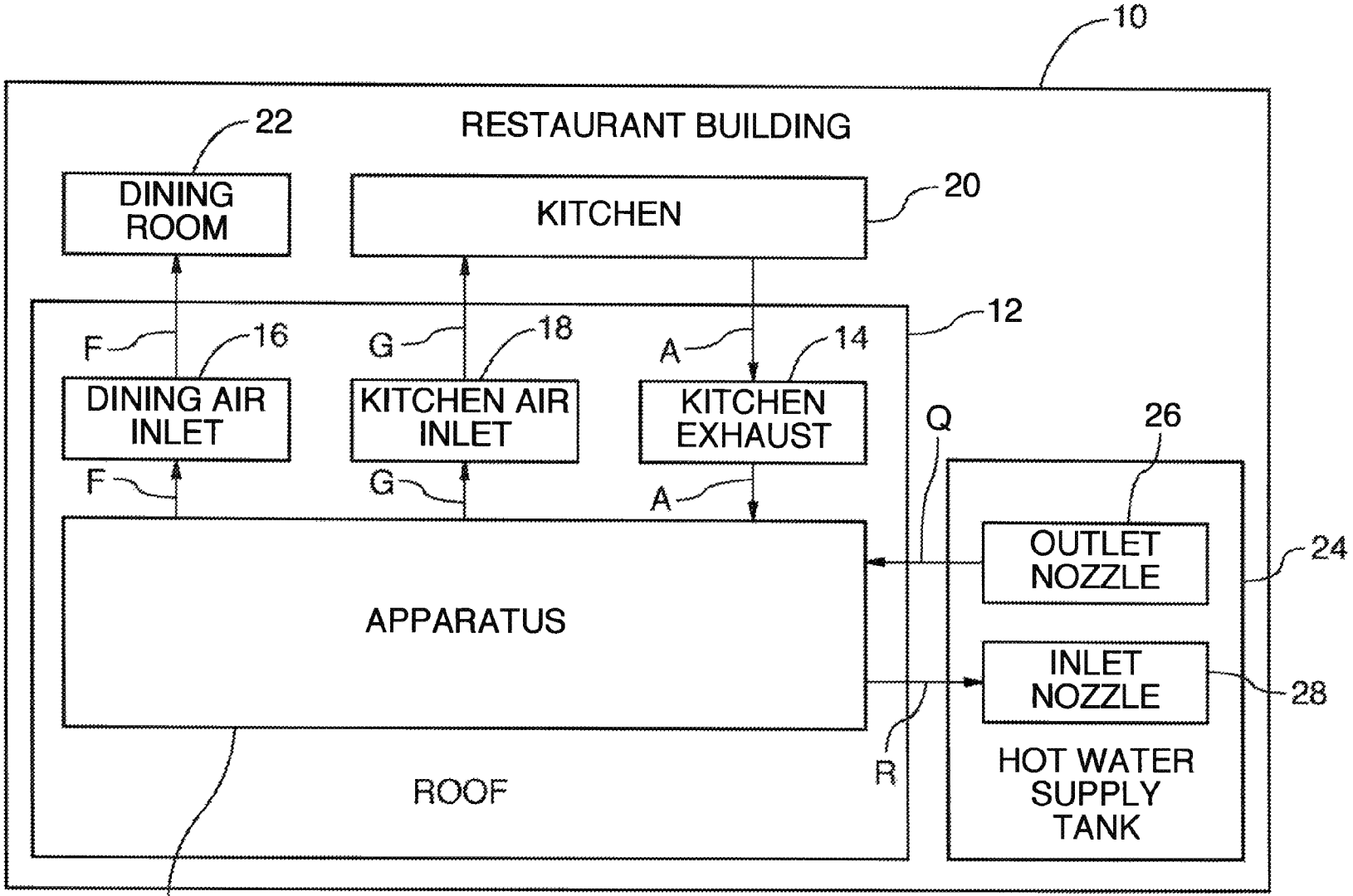
FIG. 1 of the drawings appended hereto is a schematic diagram depicting preferred embodiments of a kitchen heat recovery apparatus according to the present invention, shown in use in a restaurant building.

Referring now to FIG. 1 of the drawings, a schematic diagram of a kitchen heat recovery apparatus 30 according to the present invention is shown, in situ, as it may be preferably used in association with a restaurant building 10. It will generally be appreciated from FIG. 1 that the apparatus 30 is intended for use with exhaust air received from a restaurant kitchen 20. As is generally well-known in the prior art, the air exhausted from the restaurant kitchen 20 is typically substantially laden with grease.

Preferably, a kitchen 20 in the restaurant building 10 may vent air to the apparatus 30 from an exhaust 14 on its roof 12 (along a kitchen exhaust air flow path which is indicated generally by arrow "A"). The apparatus 30, which is particularly adapted for installation on the roof 12 of the restaurant building 10, supplies makeup air (i) through a kitchen air inlet 18 towards the kitchen 20 (along a kitchen airflow path which is indicated generally by arrow "G"), and (ii) through a dining air inlet 16 towards the dining room 22 (along a dining room airflow path which is indicated generally by arrow "F").

As shown in FIG. 1, the apparatus 30 preferably also interfaces with a hot water supply tank 24 located in the restaurant building 10. The apparatus 30 receives unheated water from an outlet nozzle 26 on the hot water supply tank 24 (along a water supply flow path which is indicated generally by arrow "Q"). In turn, the apparatus 30 provides heated water to an inlet nozzle 28 on the hot water supply tank 24 (along a water return flow path which is indicated generally by arrow "R").

Figure 4:
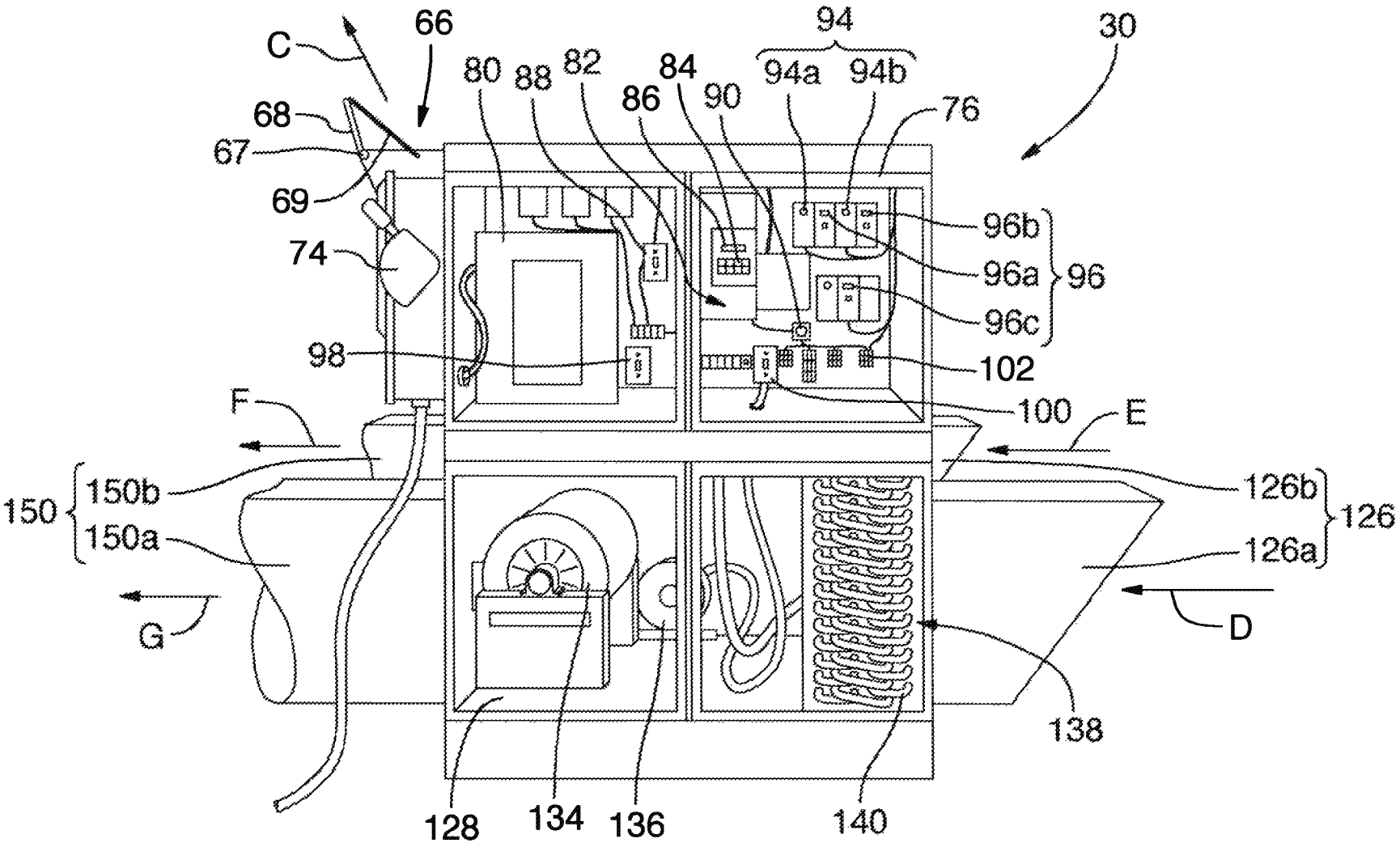
FIG. 4 is a left side view of the apparatus of FIG. 2, with control and air supply cabinets thereof shown in opened configurations.
Figure 5:
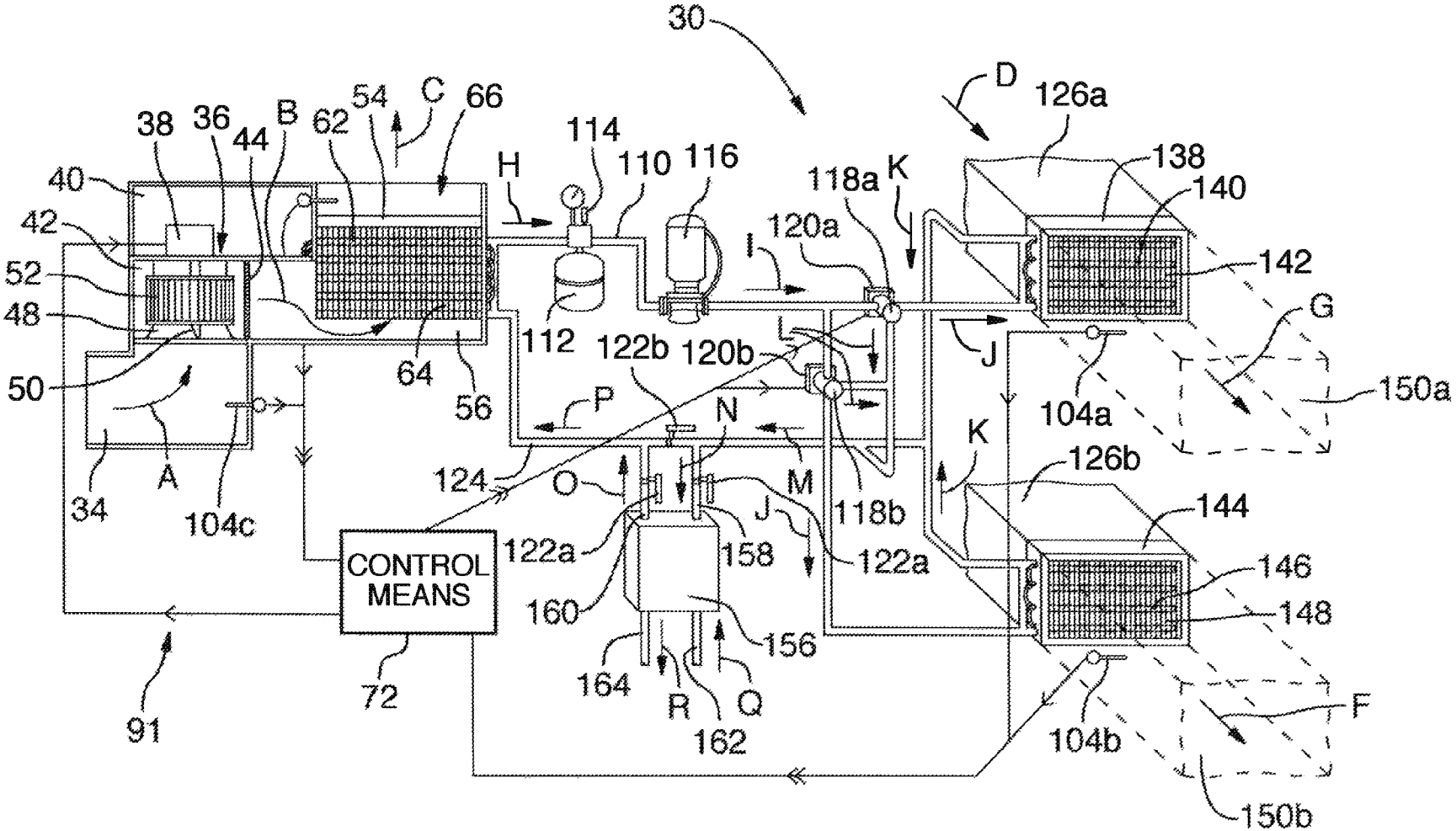
FIG. 5 is a schematic diagram of the apparatus of FIG. 2, depicting fluid delivery and heat transfer subsystems thereof.
Figure 6:
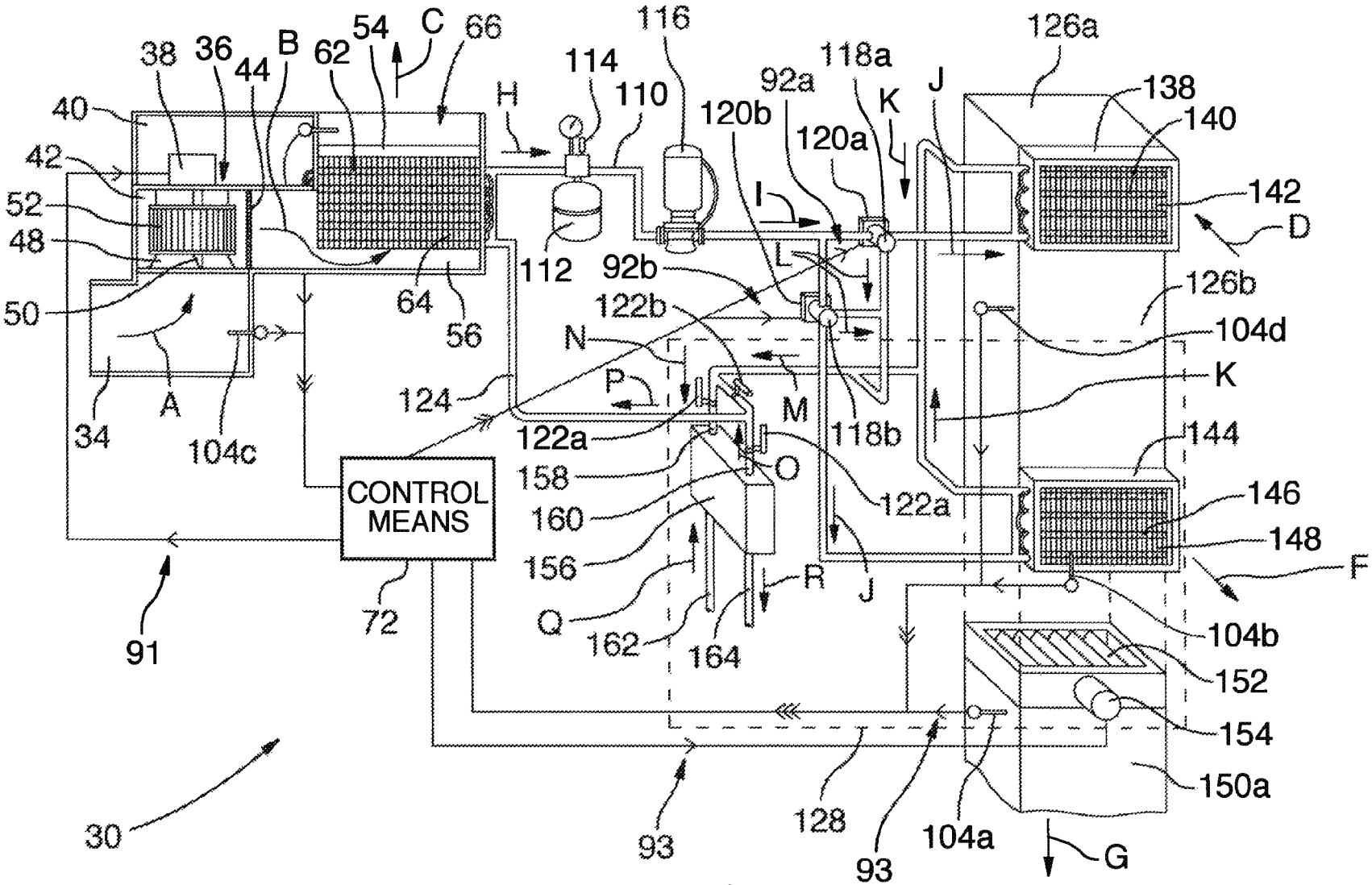
FIG. 6 is a schematic diagram, similar to FIG. 5, of a second preferred embodiment of a kitchen heat recovery apparatus according to the present invention.
Figure 7:
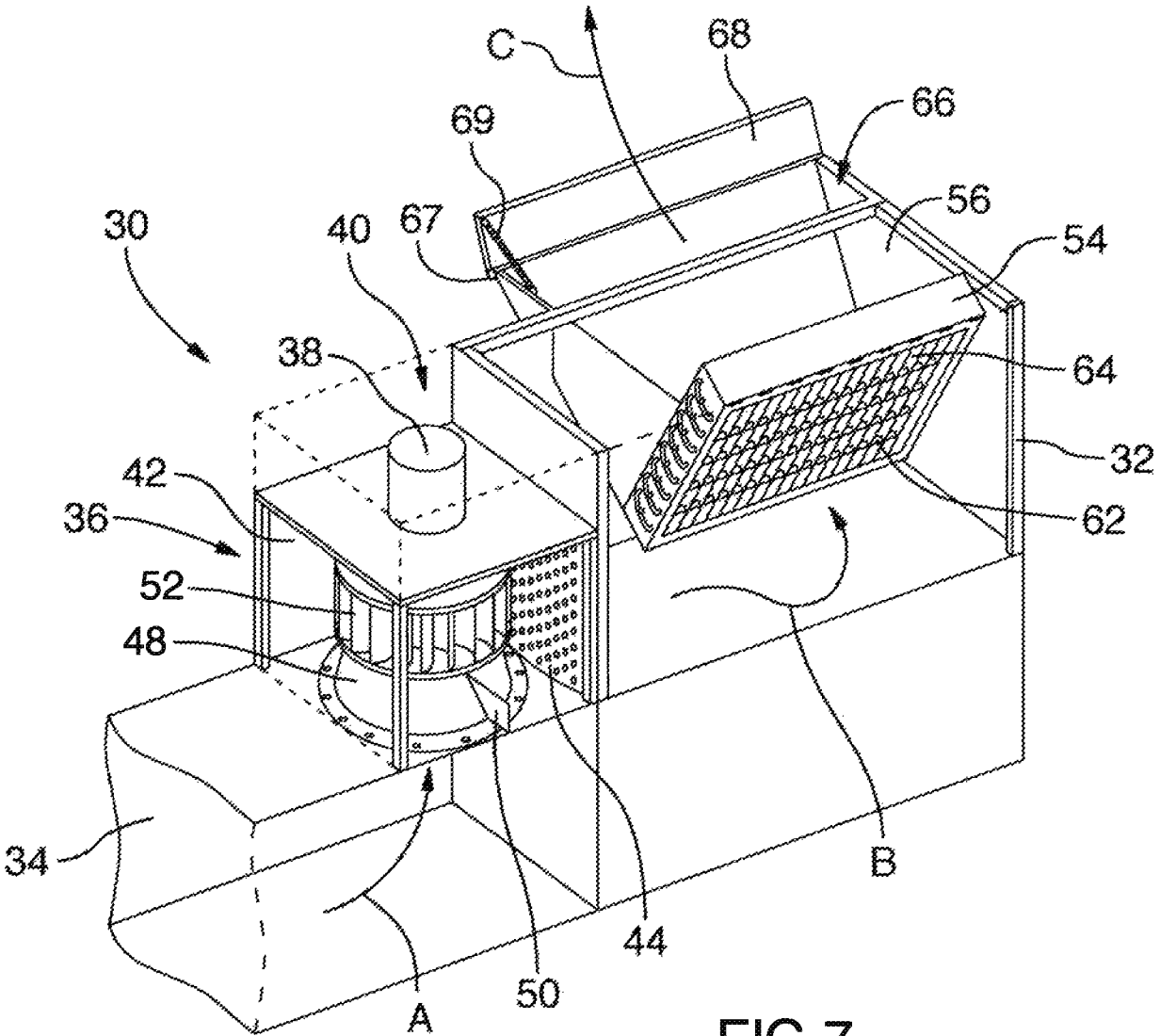
FIG. 7 is an enlarged top left perspective view of the apparatus of FIG. 6, showing of a fan and heat recovery unit thereof, with some exhaust ductwork of the apparatus being shown in phantom outline.

FIGS. 2 through 5 show a first preferred embodiment of the apparatus 30, and FIGS. 6 and 7 show a second preferred embodiment of the apparatus 30. It should perhaps be specifically noted that, in the following description, the same reference numerals have been used to indicate various components, surfaces, materials, relations, directions, and configurations which are common to the both of the preferred embodiments of the apparatus 30 which are specifically described in detail herein. It should be appreciated that, although some of the components, surfaces, materials, relations, directions, and configurations of the apparatus 30 are referenced only with respect to one of the embodiments in the following description, they may be implemented, used, and/or adapted for implementation and/or use, in association with the other embodiment.

Preferably, the apparatus 30 includes a fan 36, a heat recovery unit 54, fluid delivery means 110, heat transfer means 138, 140, 156, and fluid return means 124.

Figure 2:
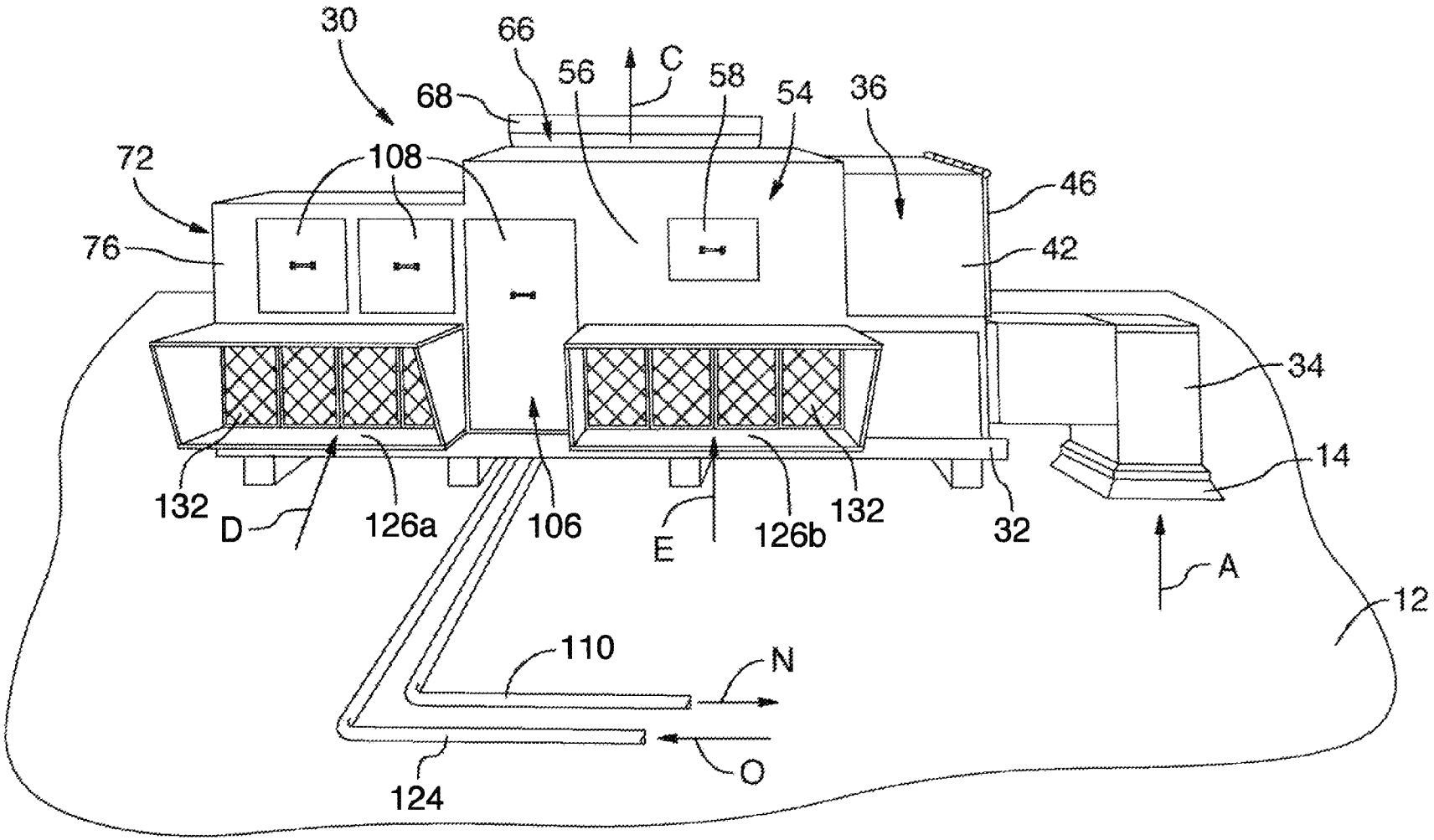
FIG. 2 of the drawings is a front view of a first preferred embodiment of a kitchen heat recovery apparatus according to of the present invention, shown on a roof of the restaurant building.
Figure 3:
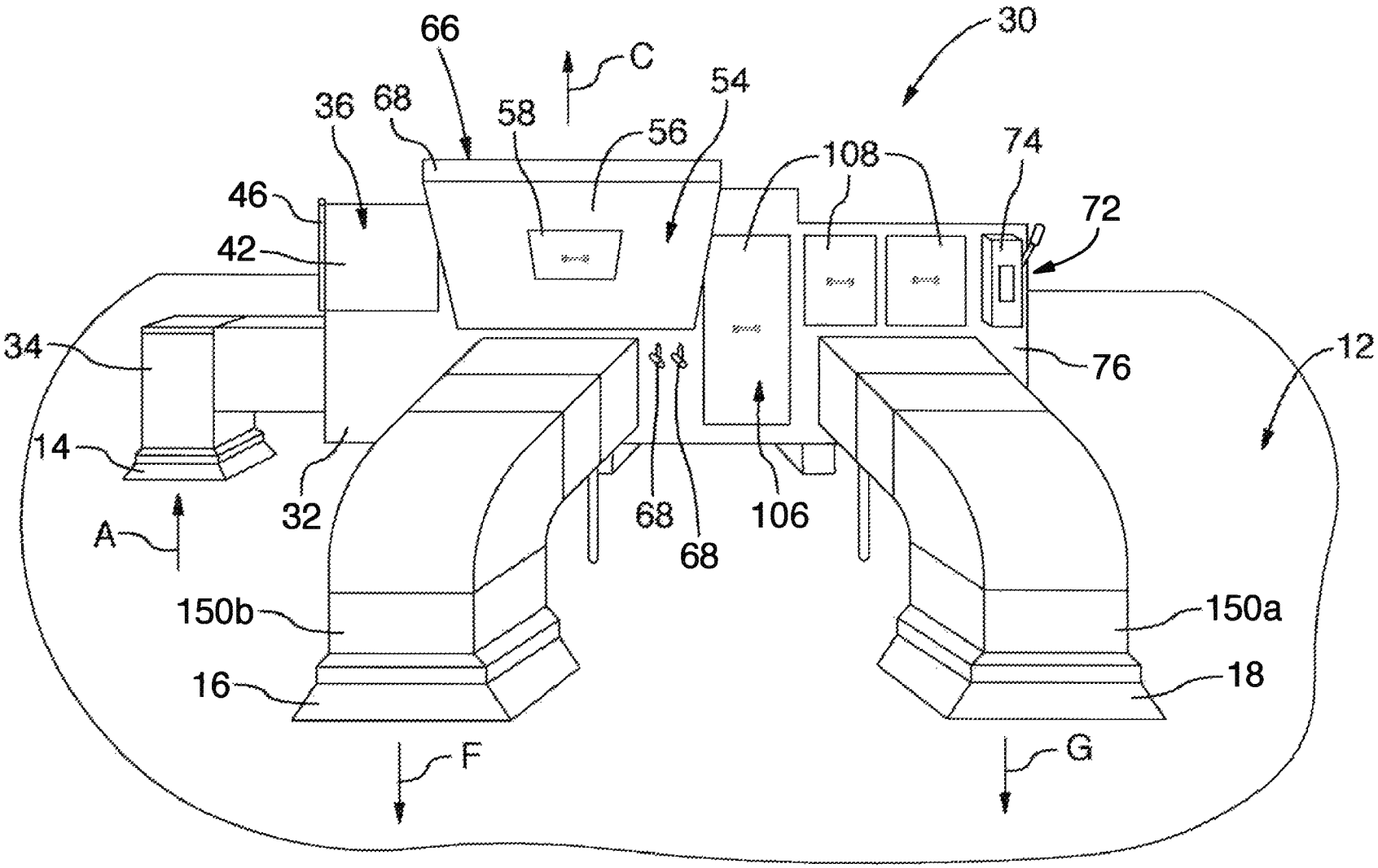
FIG. 3 is a rear view of the apparatus of FIG. 2.

As best seen in FIGS. 2 and 3, the apparatus 30 is preferably installed on the roof 12 of the restaurant building 10. A kitchen air inlet 34 of the apparatus 30 is in substantial registration, and fluid communication, with the kitchen exhaust 14 on the roof 12, so as to operatively receive vented exhaust air therefrom. The apparatus 30 includes a frame 32 which may preferably provide a structure and/or housing for some of its various parts, which parts are each discussed in substantial detail hereinbelow. The frame 32 is also adapted to provide a measure of insulation and/or protection from the elements (e.g., inclement weather) for some of the more sensitive parts of the apparatus 30.

The fan 36 includes a fan motor 38, a fan housing 42, and fan blades 52. The fan motor 38 is situated within a fan motor cabinet 40 (as best seen in FIGS. 5 to 7) that is located outside of the exhaust flow path "A". In this manner, as the fan motor 38 is not dangerously situated within the exhaust airflow path "A", the apparatus 30 may be particularly adapted for use in recovering otherwise wasted heat energy from grease-laden restaurant kitchen exhaust air.

The fan 36 is preferably a centrifugal-flow type fan, and the fan blades 52 are preferably provided with a distinct backwards-incline (as best seen in FIG. 7). The backwards inclined fan blades 52 are mounted on a fan bearing 48, which may preferably be a conically shaped fan bearing 48 (with the backwards inclined fan blades 52 being rotatably supported thereon).

As best seen in FIG. 5, the fan housing 42 substantially surrounds the fan blades 52. Both the fan blades 52 inside the fan housing 42, and the fan motor 38 inside the motor cabinet 40, may preferably be accessed from outside of the frame 32 through a reclosable access panel 46, which may preferably be provided in the form of a hinged door (as best seen in FIG. 1). In this manner, service personnel (etc.) may be permitted access to the fan motor 38 and to the interior of the housing 42. Access to the housing 42 may be particularly useful to effect a cleaning of the interior components of the fan 36 and/or the periodic emptying of one or more grease traps (not shown) which may be arranged therein.

The fan housing 42 may also preferably, but it need not necessarily, include a perforated wall 44 that may partially surround the fan blades 52. The rotating fan blades 52 generally push and accelerate the kitchen exhaust air in a centrifugal motion within the housing 42. The rotation speed and/or backwards inclined design of the fan blades 52 and/or the design of the housing 42 are such that substantially all of the grease is removed from the exhaust air (as is described in significantly greater detail hereinbelow). An air stop member 50 (best seen in FIG. 7) extends from the bearing 48, in part to reduce turbulence and/or to interfere with the formation within the housing 42 of cyclone patterns which might otherwise delay efficient exit of the exhaust air therefrom. The rotating fan blades 52 generally push the kitchen exhaust air through the perforated wall 44 towards the heat recovery unit 54 (in a direction that is indicated generally by arrow "B" in FIGS. 5 through 7). The perforated wall 44 of the fan housing 42 may, accordingly, be seen as being substantially juxtaposed between the fan blades 52 and the heat recovery unit 54 along the fan driven airflow path "B".

The heat recovery unit 54 includes a heat recovery cabinet 56 (alternately herein referred to as an exhaust duct), with a heat recovery coil 62 mounted therein. The exhaust duct 56 operatively conveys the exhaust air along the airflow path "B" in substantially unobstructed relation between the fan housing 42 and the recovery coil 62. As best seen in FIG. 7, the exhaust duct 56 may preferably, but need not necessarily, define a bend in the airflow path "B" between the fan housing 42 and the recovery coil 62. As such, any grease still remaining in the exhaust air which travels along the airflow path "B" may preferably be thrust against the exhaust duct 56, so as to be removed therefrom.

As shown in FIGS. 2 and 3, the cabinet 56 is preferably provided with removable access panels 58 to permit access and cleaning (and/or periodic emptying of grease traps, not shown) of the interior of the cabinet 56 by service personnel, etc. The cabinet 56 is preferably also provided with drain valves 60 (as best seen in FIG. 3) which may facilitate delivery and removal of a cleansing solution to the interior of the cabinet 56 during a cleaning operation.

The heat recovery coil 62 may preferably, but need not necessarily, be provided with fins 64, which may help to increase the rate of heat transfer (which is described in greater detail hereinbelow). Preferably, both the heat recovery coil 62 and the fins 64 are formed from a heat conductive material (preferably, but not necessarily, copper) that is positioned in the exhaust flow path "B" in substantially direct downstream relation from the fan housing 42 (as best seen in FIGS. 5 to 7). The heat recovery coil 62 defines recovery conduit through which a heat transfer fluid (not shown) is operatively supplied, preferably at an incoming fluid temperature that is below the temperature of the exhaust air. The specifics of the heat transfer mechanism occurring at the recovery coil 62 are discussed in greater detail hereinbelow.

Accordingly, and as best seen in FIG. 7, kitchen exhaust air passes across the neat recovery unit 54 and exits from the cabinet 56 through a kitchen exhaust vent 66 (in the general direction of arrow "C" in FIGS. 2 through 7). The exhaust vent 66 is provided with an exhaust vent door 68 which is preferably supported by a hinge 67 and a biasing chain 69 to facilitate closure of the door 68 (and protection of the heat recovery unit 54 from the elements) when the apparatus 30 is not in use.

The fluid delivery means 110 (alternatively, hereinafter referred to as fluid delivery plumbing apparatus 110) is in fluid communication with the heat recovery coil 62. The fluid delivery plumbing apparatus 110 preferably includes an expansion tank 112 downstream (in a direction generally indicated by arrow "H" in FIGS. 5 and 6) of the heat recovery unit 54. The expansion tank 112 has an internal diaphragm (not shown) which, among other things, may accommodate volumetric changes in the heat transfer fluid which may accompany shifts in temperature. The fluid delivery plumbing apparatus 110 is provided with an air scoop 114 (alternately, hereinafter referred to as the skimmer 114) substantially adjacent to, and/or downstream of, the expansion tank 112. The air scoop 114 may be useful to remove air which might otherwise be entrained in the fluid delivery means 110 (e.g., on startup, etc.). A fluid delivery pump 116 of the fluid plumbing apparatus 110 is preferably positioned downstream of the expansion tank 112 and air scoop 114 to pump the heat transfer fluid downstream (in a direction generally indicated by arrow "I" in FIGS. 5 and 6). The heat transfer means 138, 144, 156 are positioned in the downstream direction "I" from the fluid delivery pump 116.

The fluid delivery plumbing apparatus 110 also preferably includes two three-way valves 118*a*, 118*b* which are each positioned in the downstream direction "I" from the fluid delivery pump 116. The valves 118*a*, 118*b* are substantially juxtaposed, in fluid communication, between the fluid delivery pump 116 and the heat transfer means 138, 144, 156. The valves 118*a*, 118*b* receive heat transfer fluid from the pump 116 and selectively distribute the fluid to the heat transfer means 138, 144, 156, as needed (and as described in substantially greater detail hereinbelow).

In the preferred embodiments which are shown in the drawings, the heat transfer means 138, 144, 156 cooperate with one another to transfer heat energy from the fluid to makeup air for return to, and water for use in, the restaurant building. The apparatus 30 and its heat transfer means 138, 144, 156 will now be more particularly described with reference to the first preferred embodiment, which is shown in FIGS. 1 through 5.

Preferably, and as best seen in FIG. 4, the apparatus 30 includes ductwork 126 for operatively supplying makeup air to the kitchen 20 and to the dining room 22 inside the restaurant building 10. The ductwork 126 includes a first duct means 126*a* which is preferably, but not necessarily, adapted to facilitate the supply of makeup air to the kitchen 20, such that it is hereinafter alternately referred to as the kitchen supply intake 126*a*. As best seen in FIG. 2, the kitchen supply intake 126*a* receives air from the external environment which then passes through an air filter 132 towards a supply air cabinet 128 (along a kitchen intake air flow path which is indicated generally by arrow "D").

As shown in FIG. 4, the ductwork 126 also includes a second duct means 126*b* which is preferably, but not necessarily, adapted to facilitate the supply of makeup air to the dining room 22, such that it is hereinafter alternately referred to as the dining room supply intake 126*b*. As best seen in FIG. 2, the dining room supply intake 126*b* receives air from the external environment which then passes through an air filter 132 towards one of the supply air cabinets 128 (along a dining room intake airflow path which is indicated generally by arrow "E").

As best seen in FIG. 4, each of the supply air cabinets 128 may preferably include one or more supply air blowers 134. The supply air blowers 134 are preferably driven by a blower motor 136 and are preferably positioned in a downstream direction along the intake airflow paths "D", "E" from the air filters 132 (and from the heat transfer means 138, 144, as described in greater detail hereinbelow) to draw air therethrough from the external environment.

The heat transfer means 138, 144, 156 preferably includes first and second heat transfer units 138, 144. The first heat transfer unit 138 is preferably, but not necessarily, adapted to transfer heat to makeup air destined for the kitchen 20, such that it is hereinafter alternately referred to as the kitchen heat transfer unit 138. The kitchen heat transfer unit 138 is located in one of the aforesaid supply air cabinets 128, and it includes a heat transfer coil 140 that may preferably be provided with fins 142. Preferably, both the heat transfer coil 140 and the fins 142 are formed from a heat conductive material (preferably, but not necessarily, copper) that is positioned in the kitchen intake air flow path "D" in substantially direct downstream relation from the air filter 132 (as best seen in FIG. 4). As may be best appreciated from a consideration of FIG. 5, the coil 140 of the kitchen heat transfer unit 138 defines an internal conduit through which the heat transfer fluid (not shown) is, in use, selectively supplied. Preferably, the temperature of the fluid within the kitchen heat transfer coil 140 is higher than the temperature of the air which is drawn through the kitchen supply intake 126*a*.

The second heat transfer unit 144 is preferably, but not necessarily, adapted to transfer heat to makeup air destined for the dining room 22, such that it is hereinafter alternately referred to as the dining room heat transfer unit 144. The dining room heat transfer unit 144 is located in one of the aforesaid supply air cabinets (not shown). As best seen in FIG. 5, the dining room heat transfer unit 144 includes its own heat transfer coil 146 that may preferably be provided with fins 148. Preferably, both the heat transfer coil 146 and the fins 148 are formed from a heat conductive material (preferably, but not necessarily, copper) that is positioned in the kitchen intake air flow path "E" in substantially direct downstream relation from the air filter 132. As may be best appreciated from a consideration of FIG. 5, the coil 146 of the dining room heat transfer unit 144 defines an internal conduit through which the heat transfer fluid (not shown) is, in use, selectively supplied. Preferably, the temperature of the fluid within the dining room heat transfer coil 146 is higher than the temperature of the air which is drawn through the dining room supply intake 126*b*. The specifics of the heat transfer mechanisms occurring at the first and second heat transfer units 138, 144 are discussed in greater detail hereinbelow.

At this stage, it is appropriate to briefly mention a few of the differences between the first and second preferred embodiments of the apparatus 30, as may be best appreciated from a comparison of FIGS. 5 and 6, according to the present invention. The two embodiments shown in FIGS. 5 and 6 are, in most respects, identical, and the same reference numerals have been used to indicate various components, surfaces, materials, relations, directions, and configurations which are common to both of them. Notably, however, in the second preferred embodiment which is shown in FIG. 6, the first duct means 126*a* supplies makeup air along the intake airflow path "D" to both the kitchen 20 and the dining room 22 in the restaurant building 10. In this regard, it will be appreciated that the intake airflow path "D" is a main airflow path, and that it has the first heat transfer unit 138 positioned therein.

As shown in FIG. 6, the intake flow path "D" thereafter branches into two subsidiary flow paths, "F" and "G", that diverge from one another and from the main flow path "D" in a downstream direction from the first heat transfer unit 138. The subsidiary flow paths "F", "G" include a kitchen flow path "G" that selectively supplies makeup air to the kitchen 20, as well as a dining room flow path "F" that selectively supplies makeup air to the dining room 22.

As shown in FIG. 6, in the second preferred embodiment of the apparatus 30, the second heat transfer unit 144 is positioned, in the dining room flow path "F", downstream of the first heat transfer unit 138. As such, the second heat transfer unit 144 may be hereinafter referred to not only as the dining room heat transfer unit 144, but also as the booster heat transfer unit 144, insofar as it may generally be regarded as "boosting" the temperature of air which may, by then, have already been pre-heated in passage through the first heat transfer unit 138.

The second embodiment of the apparatus 30 is notably also provided with a flow impeding means 152 that is preferably, and as shown in FIG. 6, positioned in the kitchen flow path "G". The flow impeding means 152 may preferably, but not necessarily, be provided in the form of a louvered panel. The flow impeding means 152 may alternately, however, be provided in the form of any structure or apparatus which may be suitable to selectively impede supply of makeup air along at least one of the kitchen flow path "G" and the dining room flow path "F". Nonetheless, the flow impeding means 152 may herein be alternately referred to as the louvered panel 152, and vice versa (with the two terms hereinafter being used interchangeably, mutatis mutandis, with one another).

As shown in FIG. 6, the louvered panel 152 includes louvers that are selectively movable between an opened panel configuration and a closed panel configuration. In the opened panel configuration, supply of makeup air along the kitchen airflow path "F" is substantially unobstructed by the louvered panel 152. In the closed panel configuration, on the other hand, the louvered panel 152 substantially obstructs supply of makeup air along the kitchen airflow path "G". Of course, it should be appreciated that the louvered panel 152 may preferably, but need not necessarily, be positioned at substantially any position between the opened and closed panel configurations. As such, it may preferably be possible to direct only a portion of the supply air flowing from the first heat transfer unit 138 towards the second heat transfer unit 144, with the remainder being directed elsewhere (e.g., through the louvered panel 152 to the kitchen 20), as needed. Accordingly, more of the supply air may be channeled along the dining room airflow path "F" (and through the booster heat transfer unit 144), than along the kitchen airflow path "G", as needed. Movement of the louvered panel 152 between the opened and closed panel configurations is preferably mechanically actuated by a louver motor 154.

Both the first and second preferred embodiments of the apparatus 30 are provided with water plumbing means for selectively supplying water along a water flow path to the hot water supply tank 24 in the restaurant building 10. The water plumbing means preferably, and as shown in both of FIGS. 5 and 6, consists of a water supply nozzle 162 through which water is supplied to the apparatus 30 (along a supply flow path "Q" of the water flow path), and a water return nozzle 164 through which water is returned to the hot water supply tank 24 (along a return flow path "R" of the water flow path).

The heat transfer means 138, 144, 156 preferably also includes a water heat transfer unit 156 (hereinafter, alternately referred to by the abbreviation "WHTU"). Heat transfer fluid (not shown) is selectively supplied, through a fluid supply nozzle 158 along a WHTU fluid supply path (as indicated generally by arrow "N" in FIGS. 5 and 6), into an internal transfer conduit of the WHTU 156 that is formed from a heat conductive material (preferably, but not necessarily, copper). Thereafter, the heat transfer fluid preferably exits the WHTU 156 through a fluid return nozzle 160.

As shown in FIGS. 5 and 6, the heat conductive material of the water heat transfer unit 156 is positioned at a point where the water supplied through the nozzle 162, along the water supply flow path "Q", turns to water which is returned through the nozzle 164 along the water return flow path "R". The fluid entering the water heat transfer unit 156 through the supply fluid nozzle 158 is preferably supplied at a higher temperature than the temperature of the water that enters the unit 156 through the water supply nozzle 162. The specifics of the heat transfer mechanism occurring at the water heat transfer unit 156 are discussed in greater detail hereinbelow.

Another significant difference in the second embodiments of the apparatus 30 which is shown in FIG. 6 is that the water heat transfer unit 156 may preferably be positioned within the supply air cabinet 128. In this embodiment, therefore, the WHTU 156 may be heated by the air passing from the first heat transfer unit 138. As such, the water heat transfer unit 156 in the apparatus 30 shown in FIG. 6 may be less subject to temperature variations external of the apparatus 30 than in other embodiments (e.g., that shown in FIGS. 2 through 5), where the heat transfer fluid is sent to and from the WHTU 56 through fluid delivery and return means 110, 124 which are located outside of the main frame 32 of the apparatus 30. Such other embodiments may generally require significant insulation of the fluid delivery and return means 110, 124. In the second preferred embodiment of the apparatus 30, and though not shown in FIG. 6, a back-up or auxiliary heating device may be provided to ensure that the WHTU 156 is not subject to freezing in extremely cold conditions and/or in the event of an inadvertent power loss or shut-down (etc.) of the apparatus 30.

In both preferred embodiments, and as shown in FIGS. 5 and 6, a first one of the valves 118*a* is positioned in substantially juxtaposed fluid communication between the pump 116, the first heat transfer unit 138, and the water heat transfer unit 156. This valve 118*a* receives heated fluid from the pump 116 and selectively distributes it, as between the first heat transfer unit 138 and the water heat transfer unit 156. Conversely, the other one of the valves 118*b* is positioned in substantially juxtaposed fluid communication between the pump 116, the second heat transfer unit 144, and the water heat transfer unit 156. This valve 118*b* similarly receives heated fluid from the pump 116, but it selectively distributes such fluid, as between the second heat transfer unit 144 and the water heat transfer unit 156.

Each respective one of the three-way valves 118*a*, 118*b* is selectively movable between a first position and a second position. In each respective one of the first positions, the heated fluid operatively flows through the respective one of the three-way valves 118*a*, 118*b* solely towards water heat transfer unit 156 (along paths which are generally indicated by arrows "L" in FIGS. 5 and 6). Conversely, in each respective one of the second positions, the heated fluid operatively flows through the respective one of the three-way valves 118*a*, 118*b* solely towards a respective one of the first heat transfer conduit 138 and the second heat transfer conduit 144 (along paths which are generally indicated by arrows "J" in FIGS. 5 and 6).

Of course, it should be appreciated that each of the valves 118*a*, 118*b* may preferably, but need not necessarily, be positioned at substantially any position between the first and second positions. As such, it may preferably be possible to direct only a portion of the heated fluid flowing from the recovery coil 54 towards the water heat transfer unit 156, with the remainder being directed elsewhere, as needed. Fluid returning from the first and second heat transfer units 138, 144 (along paths which are generally indicated by arrows "K" in FIGS. 5 and 6) will meet up with any heated fluid which may have taken the bypassing path "L". Fluid paths "K" and "L" may then form a confluence which preferably travels towards the water heat transfer unit 156 (along the path generally indicated by arrow "M" in FIGS. 5 and 6).

It should be further appreciated that, in alternate embodiments of the invention, the valves 118*a*, 118*b* may be provided in fewer or greater numbers. Moreover, the heated fluid may be selectively distributed by one of the valves 118*a*, 118*b* only between said first and second heat transfer units 138, 144, and/or only between the first heat transfer unit 138 (or, alternately, the second heat transfer unit 144) and the water heat transfer unit 156.

The fluid return means 124 (hereinafter, alternately referred to as the fluid return plumbing apparatus 124) is preferably in fluid communication with the heat transfer means 138, 144, 156. The fluid return plumbing apparatus 124 operatively returns the heat transfer fluid to the heat recovery unit 54 (along the path generally indicated by arrow "P" in FIGS. 5 and 6).

The fluid delivery and return plumbing apparatus 110, 124 may together be provided within a plumbing cabinet 106 that has removable panels 108 (best seen in FIGS. 2 and 3) which may preferably permit access thereto by service personnel, etc.

Notably, the apparatus 30 may preferably be provided with shut-off valves 122*a* to and from the WHTU 156, as well as with a WHTU bypass valve 122*b*. The valves 122*a*, 122*b* are shown in FIGS. 5 and 6 as being manually actuated, but such need not necessarily be the case, and the apparatus 30 may instead provide for the automatic actuation of the valves 122*a*, 122*b* in certain predetermined conditions. In any case, it may be appreciated that when the shut-off valves 122 are closed, and the bypass valve 122*b* is opened, heat transfer fluid flowing along the confluent path "M" may travel directly back to the heat recovery unit 54 along the return path "P" (notably without traveling, along the intervening paths "N" and "O", to and from the water heat transfer unit 156).

The apparatus 30 preferably includes a number of temperature sensors 104*a*, 104*b*, 104*c*, 104*d*. One of these sensors, a kitchen exhaust sensor 104*c*, is positioned upstream of the heat recovery unit 54 to measure the incoming temperature of the exhaust air. Another one of the sensors is a dining room supply air sensor 104*b* which is positioned downstream of the second heat transfer unit 144 to measure the supply temperature of the makeup air exiting the apparatus 30 along the dining room airflow path "F". A further one of the sensors, an air cabinet sensor 104*d* (as shown in FIG. 6), may be positioned within the supply air cabinet 128 to measure the temperature of air downstream from the first heat transfer unit 138. Yet another one of the sensors is a kitchen supply air sensor 104*a* which is preferably positioned downstream of the first heat transfer unit 144 (and, in the embodiment of the apparatus 30 shown in FIG. 6, downstream of the louvered panel 152) to measure the supply temperature of the makeup air exiting the apparatus 30 along the kitchen airflow path "G". Other temperature and flow sensors may, of course, be provided in the apparatus 30 (e.g., a vented exhaust temperature sensor downstream of the heat recovery unit, a water temperature sensor, etc.).

The apparatus 30 also includes a control means 72 (alternately, hereinafter referred to as a controller 72) for automatically controlling various features of the apparatus 30, such as, for example, fan speed, louver movement, and heat transfer fluid delivery parameters. As best seen in FIG. 4, the control means 72 includes a control cabinet 76 and a main power supply switch 74 which is mounted outside of the cabinet 76, enabling a user to shut off the power supplied to the apparatus 30 without opening the cabinet 76 (as described in further detail hereinbelow).

Inside the cabinet 76, the control means 72 is provided with a number of electrical components which are in electrical communication with each other, including, among other things, a transformer 80, a variable speed drive unit 92, set point controls 94, sensor monitors 96, a pump on/off switch 98, a supply air blower switch 100, and contactors 102. The switch 98 is operable to turn the fluid delivery pump 116 on or off, and the switch 100 is operable to turn the blower motors 136 on or off. As shown in FIG. 4, the sensor monitors 96 include a kitchen supply temperature monitor 96*a*, a dining room supply temperature monitor 96*a*, and a kitchen exhaust temperature monitor 96*c*.

The variable speed drive unit 82 of the controller 72 is preferably in electrical communication with the exhaust sensor 104*c* and with the fan motor 38. The variable speed drive unit 82 is preferably adapted to electrically vary the amount of power which is supplied to the fan motor 38 (and, concomitantly, a rotation speed of the fan blades 52) in directly dependent relation upon the temperature measured by the exhaust sensor 104*c*.

Preferably, the variable speed drive unit 82 varies the amount of power which it supplies to the fan motor 38 on a substantially continuous basis. (The power supplied to the fan motor may be generally indicated in the drawings by the caret 91 which is shown in FIGS. 5 and 6.) As such, the rotation speed of the fan blades 52 will preferably be smoothly and substantially continuously varied over a predetermined range of desired fan speeds, with the range preferably having been preselected by a user (not shown) of the apparatus 30. For this purpose, and as best seen in FIG. 4, the variable speed drive unit 82 includes set point controls 84 for setting the fan speed range, as well as a display 86, which may show the range and/or the actual running speed of the fan 36. Preferably, the controller 72 is provided with a bypass switch 88 to enable a user, when desired, to bypass the control over the fan speed which is otherwise regulated by the variable speed drive unit 82.

At this stage, it is also worthwhile to note that the control means 72 may preferably, but need not necessarily, be provided with a time delay device 90 which, in the event that it becomes necessary to restore power to the apparatus 30 (e.g., whether following an inadvertent power loss, or a manual shut down using the main power supply switch 74), may provide a requisite time delay of perhaps a few seconds before restarting the variable speed drive unit 82—or any other time delay which may preferably be suitable to allow other components of the apparatus 30 enough time to come online and register as being in proper working order.

The louver motor 154 is preferably, but not necessarily, also electrically actuated by the controller 72. The controller 72 is preferably in electrical communication both with the dining room supply air sensor 104*b* and with the louver motor 154. In this manner, the controller 72 may send a control signal 93 (as best seen in FIG. 6) to the louver motor 154 to control movement of the louvered panel 152 to a position between the opened and closed panel configurations, in directly dependent relation upon the temperature measured by the dining room supply air sensor 104*b*. Of course, the controller 72 may instead control movement of the louvered panel 152 on the basis of other factors and/or sensed temperatures (e.g., temperature of the unboosted air within the supply air cabinet as may be measured by the air cabinet sensor 104*d*).

The apparatus 30 preferably also includes valve actuators 120*a*, 120*b* for mechanically actuating movement of each respective one of the three-way valve 118*a*, 118*b* to a position between the first and second positions. The controller 72 is, in this regard, also a valve controller that is preferably in electrical communication with one or more of the temperature sensors 104*a*, 104*b*, 104*c*, 104*d* and with the valve actuators 120*a*, 120*b*. As best seen in FIG. 6, the controller 72 may preferably and selectively send control signals 92*a*, 92*b* to each respective one of the valve actuators 120*a*, 120*b*. The control signals 92*a*, 92*b* may be operative to move the valves 118*a*, 118*b* to a position between the first and second positions. In this manner, the control means 72 and the actuators 120*a*, 120*b* are preferably able to control movement of the three-way valves 118*a*, 118*b* to various positions between the first and second positions, in dependent relation upon temperature measured by one or more of the temperature sensors 104*a*, 104*b*, 104*c*, 104*d*.

Preferably, the apparatus 30 enables a user (not shown) to predetermine how they wish to prioritize use and delivery of the heated fluid, as between supply air to the dining room 22, makeup air to the kitchen 20, and the hot water supply tank 24 for use in the restaurant building 10. For this purpose, the set point controls 94 of the control means 92 may preferably, but need not necessarily, include a kitchen supply temperature control 94*a* which is closely linked with the kitchen supply air sensor 104*a*, and a dining room supply temperature control 94*b* which is, in turn, closely linked with dining room supply air sensor 104*a*. The use of these set point controls 94*a*, 94*b* may preferably enable a user to select the temperature of the air which is desired to be supplied to each of the kitchen 20 and the dining room 22, and/or to assign a priority to one of these desired temperatures over the other. It should similarly be appreciated that it is within the scope of the invention to control the valves 118*a*, 118*b* and various other features of the apparatus 30 in dependent relation upon other observed temperatures, including, for example (and in addition to the temperatures monitored by sensors 104*c* and 104*d*), a water temperature leaving the water return nozzle 164 of the water heat transfer unit 156.

In use, the fan motor 38 operatively rotates the fan blades 52 so as to draw the exhaust air (substantially laden with grease) from the restaurant kitchen 20 along the exhaust flow path "A".

The rotating backwards inclined fan blades 52 spin at a speed which is preferably high enough to enable them to function as a grease impingement and/or extraction device. To this end, it is generally believed to be preferable for the blades to spin at a speed that is substantially within the range of between about 180 RPMs and about 2000 RPMs. It is generally believed to be even more preferable for the blades to spin at a speed that is substantially within the range of between about 800 RPMs and about 1700 RPMs. Due in part to the centrifugal nature of the fan 36 (as opposed to propeller-type fans, etc.) and to backwards incline of the fan blades 52, the aforementioned speeds are generally believed to be sufficient to enable the fan 36 to strip the grease from the air and to impel the exhaust air, and notably the grease carried aloft therein, against the internal walls of the housing 42 with sufficient force to substantially remove all of the grease therefrom. The grease substantially impinges and collects upon the internal walls of the housing 42.

Continuing rotation of the fan blades 52 then pushes the exhaust air out of the housing 42 along the substantially direct downstream path "B" to the heat recovery unit 54. At the heat recovery unit 54, the fluid inside of the heat recovery coil 62 is preferably heated by the exhaust air, in passage thereover along the path "B". Air exiting from the kitchen exhaust vent 66 is preferably substantially cooler than exhaust air initially vented from the kitchen exhaust 14 into the air intake 34. Thereafter, the fluid plumbing apparatus 110 preferably delivers the heated fluid from the recovery coil 62 to at least one of the heat transfer means 138, 144, 156.

Depending upon fluid delivery parameters (discussed above) and upon the temperature of the supplied heat transfer fluid, the air drawn through the kitchen supply intake 126*a* may preferably and selectively be heated in passage along the kitchen intake air flow path "D" over the finned first heat transfer coil 140. Similarly, the air drawn through the dining room supply intake 126*b* may preferably and selectively be heated in passage along the dining room flow path "F" over the finned second heat transfer coil 146. Additionally, the water entering the WHTU 156 through the supply nozzle 162 may preferably and selectively be heated in passage, over the heat conductive material of the water heat transfer unit 156, as it flows from the water supply flow path "Q" to the water return flow path "R".

It should be appreciated from the foregoing that the use of the apparatus 30 according to the present invention may be effective to remove substantially all of the grease from the hot kitchen exhaust air before recovering heat energy therefrom using heat exchangers—all in a single system. Moreover, the apparatus 30 may preferably provide a relatively simple, effective, and/or safe way of achieving these utilities. The apparatus 30 employs a centrifugal-type fan 36 to good effect in this regard, significantly reducing the periodic need to clean the neat recovery unit 54 that is also utilized therein. The fan 36 used in the apparatus 30 is effective to remove grease from exhaust air, without dangerously positioning the fan motor 38 within the flow path of grease-laden exhaust air. The use of the apparatus 30 significantly reduces fire hazards, making it safe and suitable for use in association with restaurant kitchen exhaust, air. In addition, the fan utilized in the apparatus 30 is adapted to substantially continuously vary, in a highly responsive manner, its speed over a user-selected range of high speeds, all in response to changes in the exhaust air temperature. Of course, one of the chief advantages of the apparatus 30, apart from the above, is the quantum leap in the degree of freedom which its use affords to a user in deciding how any heat recovered from the kitchen exhaust air should be distributed. In this regard, the apparatus 30 provides an efficient means for efficiently and automatically activating and distributing the recovered heat energy in accordance with a restaurant owner's pre-selected priority schedule. The apparatus 30 offers an efficient and highly customizable method for prioritizing the delivery of recovered heat energy as between each and every one of the following three (3) discrete systems which, according to the invention, are each recognized as being subject to their own unique heating demands in a restaurant: (a) supply air for delivery to the restaurant dining room, (b) hot water for use in the restaurant, and/or (c) makeup air for delivery back to the kitchen. The apparatus 30 is generally believed to be highly efficient at removing grease from a restaurant's kitchen exhaust air. Additionally, in pushing the largely degreased exhaust air downstream, substantially unimpeded, towards the heat recovery coil, the apparatus 30 also offers an increased efficiency, in that significant amounts of energy are not removed from the exhaust air as a result of passage through a series of filters and/or through a convoluted conduit. The apparatus 30 has been demonstrated to result in a high rate of energy transfer, in a high overall efficiency, and/or in the ability to process a large quantity of air. As such, the use of the apparatus 30 may typically afford significant savings in terms of the restaurant's electricity and/or natural gas expenses. Accordingly, the apparatus 30 is successful in obviating and/or mitigating one or more of the disadvantages of the prior art.

Various other modifications and alterations may be used in the design and manufacture of the kitchen heat recovery apparatus according to the present invention without departing from the spirit and scope of the invention, which is limited only by the accompanying claims.

We claim:

1. A kitchen heat recovery apparatus for use with exhaust air received from a restaurant kitchen, with the exhaust air being substantially laden with grease, said apparatus comprising:

a) a fan including a fan motor, a fan housing, and backwards-inclined fan blades; with said fan housing having internal housing walls that at least partially surround said fan blades; with said fan motor operatively rotating said fan blades to draw the exhaust air substantially laden with grease from the restaurant kitchen along an exhaust flow path, and to impel the exhaust air and grease against said internal housing walls, such that the grease substantially impinges and collects upon said internal housing walls, so as to remove substantially all of the grease from the exhaust air; and with said fan blades operatively rotating as aforesaid to push the exhaust air out of said fan housing in a downstream direction along said exhaust flow path; with said fan motor being positioned out of said exhaust flow path;

b) a heat recovery coil formed from a material that is heat conductive and positioned in said exhaust flow path in substantially direct downstream relation from said fan housing; with said heat recovery coil defining within itself a recovery conduit through which a heat transfer fluid is operatively supplied at an incoming fluid temperature below the temperature of the exhaust air, such that said fluid in said recovery conduit is operatively heated by passage of the exhaust air along said exhaust flow path over said heat recovery coil;

c) a fluid delivery means, in fluid communication with said recovery conduit, for operatively delivering said fluid therefrom;

d) a heat transfer means, that operatively receives said fluid after being heated within said recovery conduit as aforesaid, for transferring heat energy from said fluid to at least one of makeup air for return to, and water for use in, the restaurant;

e) a first exhaust sensor, positioned in an upstream direction from said recovery coil, to measure the temperature of the exhaust air; and, f) a fan motor controller, in electrical communication with said first exhaust sensor and with said fan motor, to electrically vary power supplied to said fan motor, and a rotation speed of said fan blades, in directly dependent relation upon the temperature of the exhaust air.

2. The kitchen heat recovery apparatus according to claim 1, wherein said power supplied to said fan motor is varied on a substantially continuous basis, such that said rotation speed of said fan blades is varied within a predetermined range of desired fan speeds.

3. The kitchen heat recovery apparatus according to claim 2, wherein said predetermined range is preselected by a user.

4. The kitchen heat recovery apparatus according to claim 2, wherein said predetermined range is substantially within the range of between 180 RPMs and 2000 RPMs.

5. The A kitchen heat recovery apparatus according to claim 4, wherein said predetermined range is substantially within the range of between 800 RPMs and 1700 RPMs.

6. The kitchen heat recovery apparatus according to claim 1, further comprising a first ducting means for operatively supplying a first current of makeup air along a first makeup flow path to at least a first one selected from the group consisting of the kitchen and a dining room of the restaurant;

wherein said heat transfer means comprises a first heat transfer coil formed from a first material that is heat conductive and positioned in said first makeup flow path; with said first heat transfer coil defining within itself a first transfer conduit through which said fluid is selectively supplied at a first heated fluid temperature above the temperature of said first current of makeup air, so as to heat said first current of makeup air in passage along said first makeup flow path over said first heat transfer coil.

7. The kitchen heat recovery apparatus according to claim 6, further comprising a second ducting means for supplying a second current of makeup air along a second makeup flow path to the respective other one selected from the group consisting of the kitchen and the dining room of the restaurant;

wherein said heat transfer means further comprises a second heat transfer coil formed at least in part from a second material that is heat conductive and positioned in said second makeup flow path; with said second heat transfer coil defining a second transfer conduit through which said fluid is selectively supplied at a second heated fluid temperature above the temperature of said second current of makeup air, so as to heat said second current of makeup air in passage along said second makeup flow path over said second heat transfer coil.

8. The kitchen heat recovery apparatus according to claim 6, further comprising a plumbing means for selectively supplying water along a water flow path to the restaurant; wherein said heat transfer means further comprises a water heat transfer unit formed from a third material that is heat conductive and positioned in said water flow path; with said water heat transfer unit defining within itself a third transfer conduit through which said fluid is selectively supplied at a third heated fluid temperature above the temperature of the water, so as to heat the water in passage along said water flow path over said water heat transfer unit.

9. The kitchen heat recovery apparatus according to claim 8, wherein said fluid delivery means comprises at least one three-way valve, positioned in substantially juxtaposed fluid communication between said recovery, said first transfer conduit, and said third transfer, to receive fluid from said recovery conduit and selectively distribute said fluid between said first transfer conduit and said third transfer conduit; wherein said three-way valve is selectively movable between a first position and a second position; wherein in said first position, said fluid operatively flows through said three-way valve solely towards said first transfer conduit; and wherein in said second position, said fluid operatively flows through said three-way valve solely towards said third transfer conduit.

10. The kitchen heat recovery apparatus according to claim 6, wherein said first ducting means operatively supplies said makeup air along said makeup flow path to the kitchen and the dining room of the restaurant, with said makeup flow path defining a main flow path having said first heat transfer coil positioned therein, and at least two subsidiary flow paths that diverge from said main flow path in a downstream direction from said first material, with said subsidiary flow paths comprising a kitchen flow path that selectively supplies said makeup air to the kitchen, and a dining room flow path that selectively supplies said makeup air to the dining room; and wherein said heat transfer means further comprises a second heat transfer coil formed from a second material that is heat conductive and positioned in said dining room flow path; with said second heat transfer coil defining within itself a second transfer conduit through which said fluid is selectively supplied at a second heated fluid temperature above the temperature of said makeup air leaving said first heat transfer coil, so as to heat said makeup air in passage along said dining room flow path over said second heat transfer coil.

11. The kitchen heat recovery apparatus according to claim 10, further comprising a flow impeding means, positioned within said first ducting means, for selectively impeding supply of said makeup air along at least one of said kitchen flow path and said dining room flow path.

12. The kitchen heat recovery apparatus according to claim 11, wherein flow impeding means comprises a louvered panel positioned in said kitchen flow path, with said louvered panel having louvers that are selectively movable between an opened panel configuration and a closed panel configuration;

wherein, in said opened panel configuration, said supply of makeup air to the kitchen is substantially unobstructed by said louvers; and wherein, in said closed panel configuration, said louvered panel substantially obstructs said supply of makeup air to the kitchen.

13. The kitchen heat recovery apparatus according to claim 12, wherein movement of said louvers between said opened panel configuration and said closed panel configuration is mechanically actuated by a louver motor, with said louver motor being electrically actuated by a louver controller.

14. The kitchen heat recovery apparatus according to claim 13, further comprising a second heat transfer coil sensor, positioned in a downstream direction from said second heat transfer coil, to measure the temperature of said makeup air leaving said second heat transfer coil;

wherein said louver controller is in electrical communication with said second heat transfer coil sensor and with said louver motor, so as to control movement of said louvers between said opened panel configuration and said closed panel configuration in directly dependent relation upon the temperature of said makeup air leaving said second heat transfer coil.

15. The kitchen heat recovery apparatus according to claim 10, wherein said fluid delivery means comprises at least one three-way valve, positioned in substantially juxtaposed fluid communication between said recovery conduit and each said transfer conduit, to receive fluid from said recovery conduit and selectively distribute said fluid between said first transfer conduit and said second transfer conduit;

wherein said three-way valve is selectively movable between a first position and a second position;

wherein in said first position, said fluid operatively flows through said three-way valve solely towards said first transfer conduit; and wherein in said second position, said fluid operatively flows through said three-way valve solely towards said second transfer conduit.

16. The kitchen heat recovery apparatus according to claim 10, further comprising a plumbing means for selectively supplying water along a water flow path to the restaurant;

wherein said heat transfer means further comprises a water heat transfer unit formed from a third material that is heat conductive and positioned in said water flow path; with said water heat transfer unit defining within itself a third transfer conduit through which said fluid is selectively supplied at a third heated fluid temperature above the temperature of the water, so as to heat the water in passage along said water flow path over said water heat transfer unit.

17. The kitchen heat recovery apparatus according to claim 16, wherein said fluid delivery means comprises a first three-way valve and a second three-way valve;

wherein said first three-way valve is positioned in substantially juxtaposed fluid communication between said recovery conduit, said first transfer conduit, and said third transfer conduit, so as to receive fluid from said recovery conduit and selectively distribute said fluid between said first transfer conduit and said third transfer conduit;

wherein said second three-way valve is positioned in substantially juxtaposed fluid communication between said recovery conduit, said second transfer conduit, and said third transfer conduit, so as to receive fluid from said recovery conduit and selectively distribute said fluid between said second transfer conduit and said third transfer conduit;

wherein each respective said three-way valve is selectively movable between a first position and a second position;

wherein in each respective said first position, said fluid operatively flows through said respective said three-way valve solely towards said third transfer conduit; and wherein in each respective said second position, said fluid operatively flows through said respective said three-way valve solely towards a respective one of said first transfer conduit and said second transfer conduit.

18. The kitchen heat recovery apparatus according to claim 17, further comprising a valve controller for electrically actuating movement of each respective said three-way valve between said first position and said second position.

19. The kitchen heat recovery apparatus according to claim 18, further comprising at least one temperature sensor to measure a current temperature of a selected one of the exhaust air, said water for the restaurant, and said makeup air supplied to one of the kitchen and the dining room;

wherein said valve controller is in electrical communication with said temperature sensor and with at least one said three-way valve, so as to control movement of said three-way valve between said first position and said second position in dependent relation upon said current temperature.

20. The kitchen heat recovery apparatus according to claim 19, wherein said valve controller electrically actuates movement of each respective said three-way valve between said first position and said second position in dependent relation upon a predetermined prioritization of heat energy transfer as between at least two of the dining room, the kitchen, and the water for use in the restaurant.

21. The kitchen heat recovery apparatus according to claim 10, wherein each said heat transfer coil is a finned heat transfer coil.

22. The kitchen heat recovery apparatus according to claim 1, further comprising a plumbing means for selectively supplying water along a water flow path to the restaurant; wherein said heat transfer means further comprises a water heat transfer unit formed from a third material that is heat conductive and positioned in said water flow path; with said water heat transfer unit defining a third transfer conduit through which said fluid is selectively supplied at a third heated fluid temperature above the temperature of the water, so as to heat the water in passage along said water flow path over said water heat transfer unit.

23. The kitchen heat recovery apparatus according to claim 1, wherein said fan housing comprises a perforated housing wall substantially juxtaposed between said fan blades and said recovery coil along said exhaust flow path, with an inner face of said perforated housing wall defining one of said internal housing walls.

24. The kitchen heat recovery apparatus according to claim 1, further comprising an exhaust duct that operatively conveys said exhaust air along said flow path in substantially unobstructed relation between said fan housing and said recovery coil.

25. The kitchen heat recovery apparatus according to claim 24, wherein said exhaust duct defines a bend in said flow path between said fan housing and said recovery coil.

26. The kitchen heat recovery apparatus according to claim 1, wherein said fluid delivery means comprises an expansion tank having an internal diaphragm, an air scoop, and a fluid delivery pump, with said expansion tank being positioned in a substantially downstream fluid direction from said recovery coil, with said air scoop being positioned in said substantially downstream fluid direction from said expansion tank, and with said fluid delivery pump being positioned in said substantially downstream fluid direction from said air scoop, with said heat transfer means being positioned in said substantially downstream direction from said fluid delivery pump.

27. The A kitchen heat recovery apparatus according to claim 1, further comprising fluid return means, in fluid communication with said heat transfer means, for operatively returning said fluid to said recovery coil.

28. The kitchen heat recovery apparatus according to claim 1, wherein said apparatus is mounted on a roof.

29. The kitchen heat recovery apparatus according to claim 1, wherein each said heat conductive material is copper.

* * * * *